United States Patent [19]

Matsumoto

[11] 4,326,861

[45] Apr. 27, 1982

[54] DUST-COLLECTING ASSEMBLY FOR ELECTROSTATIC PRECIPITATOR

[75] Inventor: Yoichi Matsumoto, Kobe, Japan

[73] Assignee: Metallgesellschaft Aktiengesellschaft, Frankfurt am Main, Fed. Rep. of Germany

[21] Appl. No.: 884,805

[22] Filed: Mar. 9, 1978

[30] Foreign Application Priority Data

Apr. 28, 1977 [JP] Japan ..... 52-48549

[51] Int. Cl.[3] ..... B03C 3/41; B03C 3/76

[52] U.S. Cl. ..... 55/112; 55/137; 55/148; 55/152

[58] Field of Search ..... 55/137, 148, 150, 152, 55/154, 112

[56] References Cited

U.S. PATENT DOCUMENTS

| | | | |
|---|---|---|---|
| 1,981,455 | 11/1934 | Knight | 55/112 |
| 2,983,847 | 5/1961 | Spengler | 55/152 UX |
| 3,014,154 | 12/1961 | Ehlers et al. | 55/150 UX |
| 3,362,135 | 1/1968 | Steuernagel et al. | 55/152 X |
| 3,435,594 | 4/1969 | Steuernagel | 55/112 |
| 3,485,011 | 12/1969 | Archer et al. | 55/152 X |
| 3,530,645 | 9/1970 | De Lisio | 55/112 |
| 3,958,962 | 5/1976 | Hayashi | 55/152 X |

FOREIGN PATENT DOCUMENTS

| | | | |
|---|---|---|---|
| 441912 | 3/1927 | Fed. Rep. of Germany | 55/150 |
| 533847 | 9/1931 | Fed. Rep. of Germany | 55/150 |
| 833799 | 3/1952 | Fed. Rep. of Germany | 55/150 |
| 548448 | 1/1923 | France | 55/130 |
| 716959 | 10/1954 | United Kingdom | 55/150 |
| 747301 | 4/1956 | United Kingdom | 55/154 |

*Primary Examiner*—Kathleen J. Prunner
*Attorney, Agent, or Firm*—Karl F. Ross

[57] ABSTRACT

An electrostatic precipitator has a dust-collecting assembly wherein a pair of dust-collecting electrodes, usually at positive polarity, flank an array of discharge electrodes (at negative polarity) having corona-discharge parts or edges. According to the invention, the discharge electrodes have, opposite the corona-generating points or edges, broad surfaces of a large radius of curvature to serve as collecting surfaces for dust particles charged by reverse ionization. Advantageously, along the path of the gas through the assembly, the corona-discharge and collector surfaces of the discharge electrodes alternate with one another.

1 Claim, 7 Drawing Figures

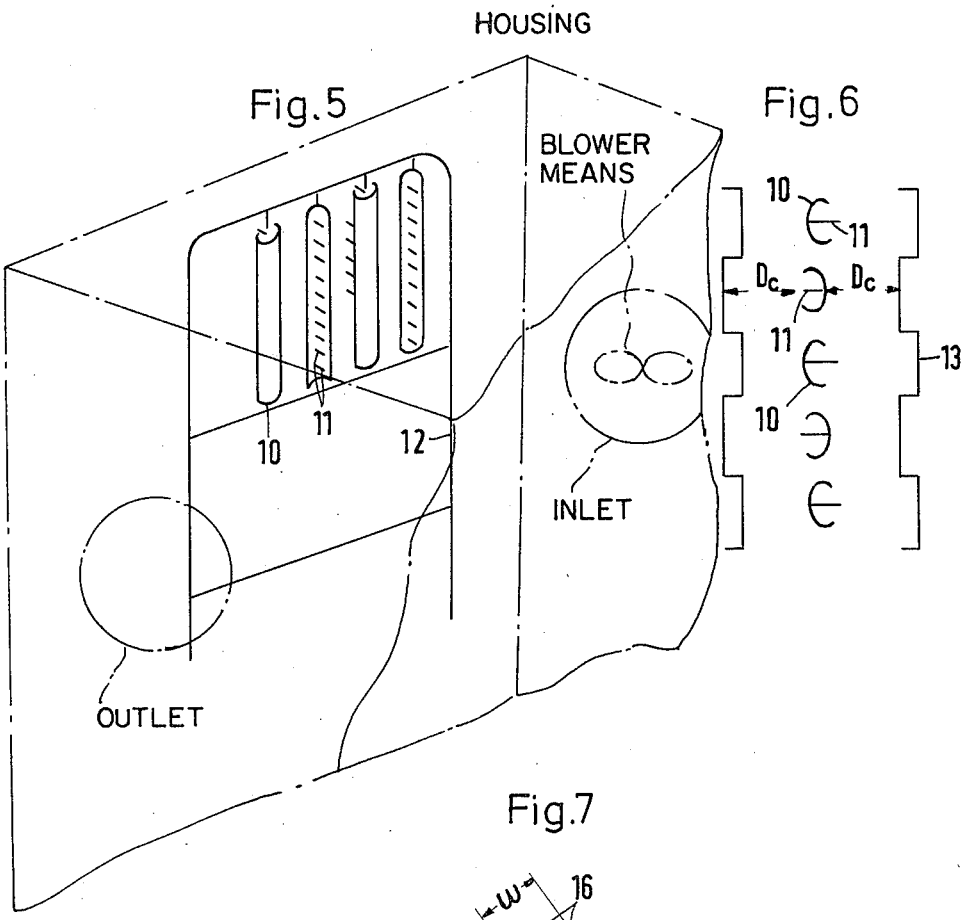
Fig.7
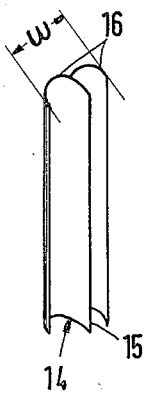

DUST-COLLECTING ASSEMBLY FOR ELECTROSTATIC PRECIPITATOR

FIELD OF THE INVENTION

The present invention relates to a dust-collecting assembly for an electrostatic precipitator and, more particularly, to a system for reducing or eliminating the detrimental effects of reverse ionization upon the removal of high-resistance dusts from a gas stream.

BACKGROUND OF THE INVENTION

An electrostatic precipitator generally comprises an array of vertically extending dust-collecting electrodes which are maintained at a relatively positive polarity by being connected to one terminal of a high-voltage direct-current source, an array of discharge electrodes having points (thorns or barbs) or sharp edges constituting corona-discharge regions. Below the base of the collecting electrodes, suitable collecting bins are provided and the collecting electrodes are associated with rapping means for dislodging the collected dust into the bins. The dust-collecting assembly thus consists of a pair of such dust-collecting electrodes defining a passage for the gas between them, the collecting electrodes spacedly flanking the array of corona-discharge electrodes.

Generally speaking, the corona-discharge electrodes are at negative polarity and are connected to the opposite terminal of the high-voltage direct-current source. The corona discharge generated between the edges or barbs (points) of the discharge electrode and the opposite portion of a collecting electrode results in ionization of gases and the generation of charged particles, e.g. negative ions or electrons which are picked up by the dust particles so that the latter become negatively charged. The dust particles are then attracted to and collect upon the positively charged collector electrodes to which they adhere electrostatically or mechanically until the collecting electrode is rapped to dislodge the dust into the bins.

It has been found to be advantageous to pass the gas which can be laden with the dust generally horizontally between the vertical collecting electrodes.

As will be apparent hereinafter from the specific description of both the prior art and the invention, the process just described, in the case of high-resistance dusts, results in some reverse ionization at the side of the collecting electrode at which the dust accumulates. As a result, positively charged dust particles may be released or formed by such reverse ionization and naturally such positively charged particles are repelled from and not attracted to the positively charged dust-collecting surface. As the gas stream passes horizontally between the dust-collecting electrodes, therefore, particles which pick up a positive charge by reverse ionization proximal to a collecting electrode tend to move toward the next discharge electrode at which they may pick up a negative charge and then move toward the collecting electrode where they may again pick up a positive charge, etc. Viewed as a statistical phenomenon, therefore, particles of dust tend to move in a zigzag fashion between the plane of the discharge electrodes and the collecting electrodes spaced therefrom as the gas entrains such particles along the collecting path. The zig-zag movement is a phenomenon which is associated with high-resistance dusts.

Because of the zig-zag phenomenon, the effectiveness of dust collection is obviously reduced and hence the performance of a dust-collecting or dust-arresting assembly will be substantially lower for high-resistance dusts than with normal or low-resistance dusts.

One obvious solution to the problem is to increase the conductivity of the dust which is processed. The art has recognized this and in many cases has provided for the introduction of moisture or for the humidification of the dust before the gas stream enters the assembly. Naturally, this procedure cannot be used in all cases and depends upon the nature of the gas stream, the nature of the dust and the parameters under which the system operates. However, it is important to improve the efficiency of dust-collecting assemblies for high-resistance dusts.

OBJECTS OF THE INVENTION

It is the principal object of the present invention to provide a dust-arresting assembly with improved efficiency in the collection of high-resistance dusts.

Another object of the invention is to provide an improved electrostatic precipitator construction which avoids problems of earlier systems and affords increased efficiency in the removal of high-resistance dusts from gas streams containing same.

It is a further object of this invention to provide an improved low-cost system for removing high-resistance dust and other particulates from a gas stream without requiring pretreatment of the dust or the gas stream.

SUMMARY OF THE INVENTION

These objects and others which will become apparent hereinafter are attained, in accordance with the present invention, in a system for the removal of high-resistance dusts from a gas stream and, more particularly, in an electrode assembly for the removal of high-resistance dust in an electrostatic precipitator, which utilizes a unique construction of the corona-discharge electrodes whereby the surface of the corona-discharge electrodes facing away from the side thereof provided with the corona-generating means, i.e. edges, points, barbs or thorns, has a large convex surface area to form a collecting surface for reversely polarized dust resulting from this reverse ionization.

According to the invention, therefore, the electrostatic dust-arrestor assembly of the present invention comprises electric discharge electrodes disposed between the arresting or collecting electrodes, each of the discharge electrodes having one side confronting one of the collecting electrodes and formed as a discharging part provided with sharp edges or thorns at which the corona discharge is primarily generated. The discharge electrodes may be transversely spaced from one another and are relatively thin and elongated while extending transversely to the direction of flow of the gas and parallel to the collecting electrodes which are constituted as plates. The discharge electrodes between each pair of plates thus lie in a planar array so that the plane of the array is parallel to the direction of flow of the gas stream and to the collecting electrodes spacedly flanking the array.

According to the principles of the invention enunciated earlier, the other side of each of the discharge electrodes, confronting the other collecting electrode on the side opposite that at which the corona-generating means is provided, is formed as an electric-field-forming part which is suitably rounded and convex in the direction of this other collecting electrode.

According to a feature of the invention, the discharge electrodes are so oriented and disposed that discharging and field-forming parts alternate with one another in the direction of flow of the gas to be treated.

The present invention utilizes the discovery that, by forming the field part of each discharge electrode with a convex contour in the direction of the collecting electrode juxtaposed therewith and of a breadth which significantly exceeds the breadth of the corona-generating means, dust particles at the collecting electrode which have been charged to the polarity at which this electrode is maintained by the reverse ionization process described previously, are attracted to the field-forming part of the discharge electrode and are collected thereby.

More specifically, the dust particles near the arresting or collecting electrode which have been charged to a plus or positive polarity by the positive ions resulting from reverse ionization are conveniently collected by the field-forming part of the discharge electrode. Meanwhile, the dust particles around the discharge part (i.e. in the region of the corona-generating means) which are charged to negative or minus polarity are caught by the collecting electrode. The foregoing requires, naturally, that the collection electrodes be at a relatively more positive polarity than the discharge electrodes.

Consequently, the zig-zag flow of dust particles attributable to reverse ionization is greatly limited and the performance of the dust-arresting assembly is significantly improved so that high-resistance dusts with which reverse ionization is a particular problem, are intercepted with high efficiency.

BRIEF DESCRIPTION OF THE DRAWING

The above and other objects, features and advantages of the present invention will become more readily apparent from the following description, reference being made to the accompanying drawing in which:

FIG. 5 is a diagrammatic perspective view illustrating the mounting of collecting electrodes in accordance with the present invention;

FIG. 6 is another view similar to FIG. 3 illustrating still another embodiment of a dust-arresting assembly according to the invention; and FIG. 7 is a perspective view showing another embodiment of a discharge electrode according to the invention.

SPECIFIC DESCRIPTION

Figure 1:
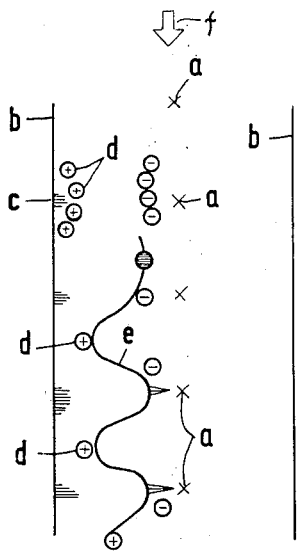
FIG. 1 is a schematic plan view of a prior-art dust-arresting assembly.

FIG. 1 shows the principles of a prior-art dust-arresting assembly for an electrostatic precipitator.

Let us assume that the assembly comprises a planar array of discharge electrodes a between a pair of planar or plate-shaped collecting electrodes b which thus flank the array of discharge electrodes. It is customary to provide the discharge electrodes as strips or wires which, in the structure illustrated, can be assumed to run perpendicular to the plane of the paper. The discharge electrodes, moreover, will be assumed to be connected to the negative terminal of a high-voltage direct current source (not shown) whose positive terminal is connected to the electrode plates b. The gas traverses the channel formed between the plates b in the direction of arrow f. The plates b and the electrodes a generally are disposed vertically and the gas stream passes through the channel horizontally.

Naturally, the entire assembly is normally enclosed in a housing provided with an inlet and an outlet for the gas and, if desired, with blower means for inducing the flow of gas through the assembly. At the bottom of this housing there may be provided one or more bins for collection of dust and the plates b can be formed in the conventional manner with rapping means inducing the shedding of dust from the collector plates from time to time.

In the operation of the assembly shown in FIG. 1, a corona discharge surrounds each of the electrodes a and generally charges the dust particles in the region of these electrodes with negative polarity as has been represented in the drawing. The negatively charged dust particles are attracted to and accumulated upon the positively charged plates b in the normal dust-collection process.

Especially when high-resistance dusts are to be recovered, it is found that a reverse ionization can be generated at locations c of the collecting electrodes to impart positive charges to the dust particles d in the region thereof. The result of this normal ionization/-reverse ionization is that, as the gas traverses the system, statistically speaking, particles are charged negatively and positively alternately and describe a zig-zag path as noted at e between the array of discharge electrodes a and a plate b. In other words, there is an extended path of dust through the assembly without pickup or collection of the dust by the plates b. Obviously this phenomenon results in reduced efficiency.

The disadvantages of the prior-art system of FIG. 1 can be overcome by substituting, for the discharge electrodes thereof, a discharge electrode having any of the configurations in accordance with the present invention and particularly shown in FIGS. 2–4 and 7.

Figure 2:
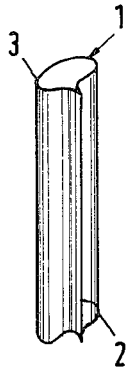
PRIOR ART Fig.2
FIG. 2 is a perspective view of a discharge electrode in accordance with one embodiment of the invention.

In the embodiment of FIG. 2, for example, the electrode 1 is a tubular body formed from sheet metal, i.e. a bent strip welded and sharpened to form a keen edge 2 which projects from one side of the electrode and constitutes the corona-generating means thereof. Opposite the corona-generating side of the electrode, the latter is formed with an outwardly convex curve portion 3 which constitutes a field-forming part having a large radius of curvature.

Figure 3:
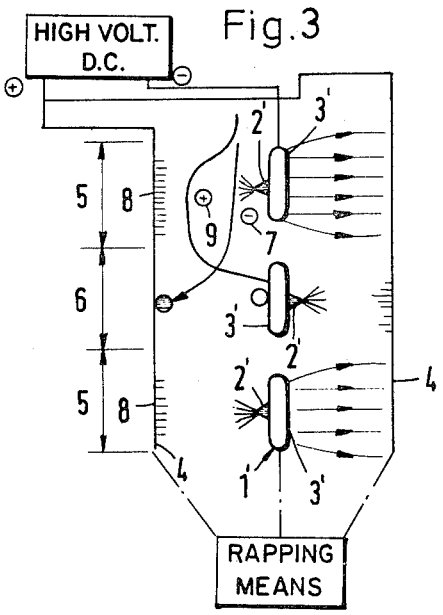
FIG. 3 is a view similar to FIG. 1 but illustrating the system of the present invention.

A modified discharge electrode has been illustrated at 1' in FIG. 3 and comprises a flattened, elliptical-cross-section sheet-metal body 1' whose rear wall or surface 3' is convex away from the corona-discharge means and has a body surface confronting the respective collecting electrode 4. From the opposite surface or wall of the electrode, points 2' project to constitute barbs which form the corona-producing means.

In this embodiment the surfaces 3' are parallel to the juxtaposed planar collecting plates 4 so that the radius of curvature, at least over part of the width of each discharge electrode 1' can be considered to be infinite.

As has been described previously, the discharge electrodes 1, 1' are disposed in a planar array with predetermined spacing between them, flanked by the two parallel, planar dust-arresting electrodes 4 and along a line parallel to the planes of the dust-arresting electrodes with their corona-producing parts and field-forming parts alternating in the direction of gas flow through the assembly. In other words, each discharge electrode 1 or 1' is rotated through 180° about its longitudinal axis with respect to the next and the successive discharge electrodes are of alternating orientation.

In operation, the discharge electrodes 1, 1' are held at minus or negative potential while the dust-arresting electrodes 4 are held at plus or positive potential. As the gas flows between the electrodes 4, a negative corona discharge is generated at the discharge parts 2, 2' of the electrodes 1, 1' over a region of length 5 so that over this region the dust particles are charged negatively and are attracted to the positively charged plates. The negatively charged particles are generally attracted to the regions 6 between the zones 5 and preferentially collect thereon. As indicated at 8, reverse ionization may occur to produce positively charged particles 9 which are attracted to the surfaces 3' of the discharge electrodes by the electric field force predominating between the surfaces 3' and the opposite regions 6 of the plates 4. Because the negatively charged particles 7 are collected in the regions 6 of the plates 4 and the positively charged particles are collected on the surfaces 3, 3' on the discharge electrodes, the zig-zag flow of dust characteristic of conventional arresting assemblies does not occur.

Figure 4:
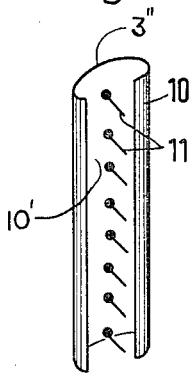
FIG. 4 is a view similar to FIG. 2 showing another embodiment of the collecting electrode of the invention.

FIGS. 4–6 show another embodiment of the invention in which the discharge electrodes 10 have a C-shaped cross-section with the convex side constituting the field-forming parts 3''. From the center of the concavity of these electrodes 10, there project a multiplicity of thorns or needles 11 which are spaced apart by a predetermined distance in the longitudinal direction and lie perpendicular to the inner surface 10'. Needles 11 may be welded to the surface 10'.

The discharge electrodes 10 are so secured to a frame 12 that the needles of successive electrodes 10 are directed to alternately opposite sides. In addition, as can be seen from FIG. 6, the arresting electrodes 13 can have a stepped cross-section so that the distance $D_c$ (D concave) between the end of a needle and the confronting wall of the electrode 13 is greater than the distance $D_C$ (D convex) between the surface 3'' and the opposite wall of the plate 13.

The intensities of the electric fields of the convex and concave sides of the discharge electrode 10 are given by the following relationships:

$$E_c = V/D_c$$

$$E_C = V/D_C$$

where $E_c$ is the electric field intensity at the concave side and $E_C$ is the electric field intensity at the convex side.

Since $D_c$ is greater than $D_C$, as mentioned above, the intensity $E_c$ is also less than $E_C$, thereby reducing reverse ionization. The higher value of $E_C$ promotes dust collection at the discharge electrodes which can be rapped in accordance with procedures used for the rapping of collecting electrodes heretofore.

FIG. 7 shows still another embodiment in which the discharge electrode 14 has a projecting central rib provided with a sharp edge 15 between semicylindrical sections 16 forming the field part of the electrode. The width W of the curved surfaces 16 can be 50 mm or greater. This electrode may be substituted for the electrodes 1, 1' and 10 previously described and with similar effects.

I claim:

1. A dust-arresting assembly for use in an electrostatic precipitator having a housing provided with an inlet and an outlet and a blower for inducing the flow of a gas stream entraining high-resistance dust through said housing in a gas-flow direction, said assembly being located within said housing and comprising:

a pair of mutually parallel dust-collecting electrodes spaced apart in said housing to define a passage for said gas between them;

a support frame in said housing;

an array of elongated discharge electrodes disposed between said collecting electrodes and suspended from said support frame, each of said discharge electrodes having a C-shaped cross section opening on one side thereof confronting one of said collecting electrodes, the opposite side of each discharge electrode confronting the other collecting electrode with a broad-surface field-forming part convex toward said other collecting electrode and adapted to collect particles from said gas charged by reverse ionization, each discharge electrode having a multiplicity of spaced-apart needles in a row reaching from the bottom of the respective C and extending out of the C toward the respective said one of said collecting electrodes to form corona-producing means, the successive discharge electrodes along the path of the gas between said collecting electrodes being of alternating orientation with their corona-producing means facing alternately in opposite directions, cross sections through said discharge electrodes in planes perpendicular to their longitudinal dimensions being elongated in the direction of gas flow;

a high-voltage direct current source having its positive terminal connected to said collecting electrodes and its negative terminal connected to said discharge electrodes whereby said broad surfaces collect particles charged by reverse ionization; and rapping means for rapping said collecting electrodes and for rapping said discharge electrodes for the dislodgement of dust therefrom.

* * * * *